United States Patent [19]

Oberhelman

[11] 4,126,300

[45] Nov. 21, 1978

[54] HOOD FOR STEEL PROCESSING VESSEL

[75] Inventor: Henry A. Oberhelman, Hillsboro, Oreg.

[73] Assignee: Esco Corporation, Portland, Oreg.

[21] Appl. No.: 872,991

[22] Filed: Jan. 27, 1978

[51] Int. Cl.[2] ..... C21C 5/38

[52] U.S. Cl. ..... 266/158

[58] Field of Search ..... 75/60; 98/115 R, 115 VM; 266/142, 143, 158

[56] References Cited

U.S. PATENT DOCUMENTS 3,501,579 3/1970 Nasierowski et al. ..... 266/158

*Primary Examiner*—Gerald A. Dost

*Attorney, Agent, or Firm*—Tilton, Fallon, Lungmus & Chestnut

[57] ABSTRACT

A hood suitable for a steel processing vessel particularly one utilizing argon-oxygen decarburization where the hood has a fixed part and a movable part, the movable part facilitating replacement of the vessel, the movable part also having a draft damper providing for different exhaust air flow for different operating conditions.

3 Claims, 6 Drawing Figures

FIG. 3
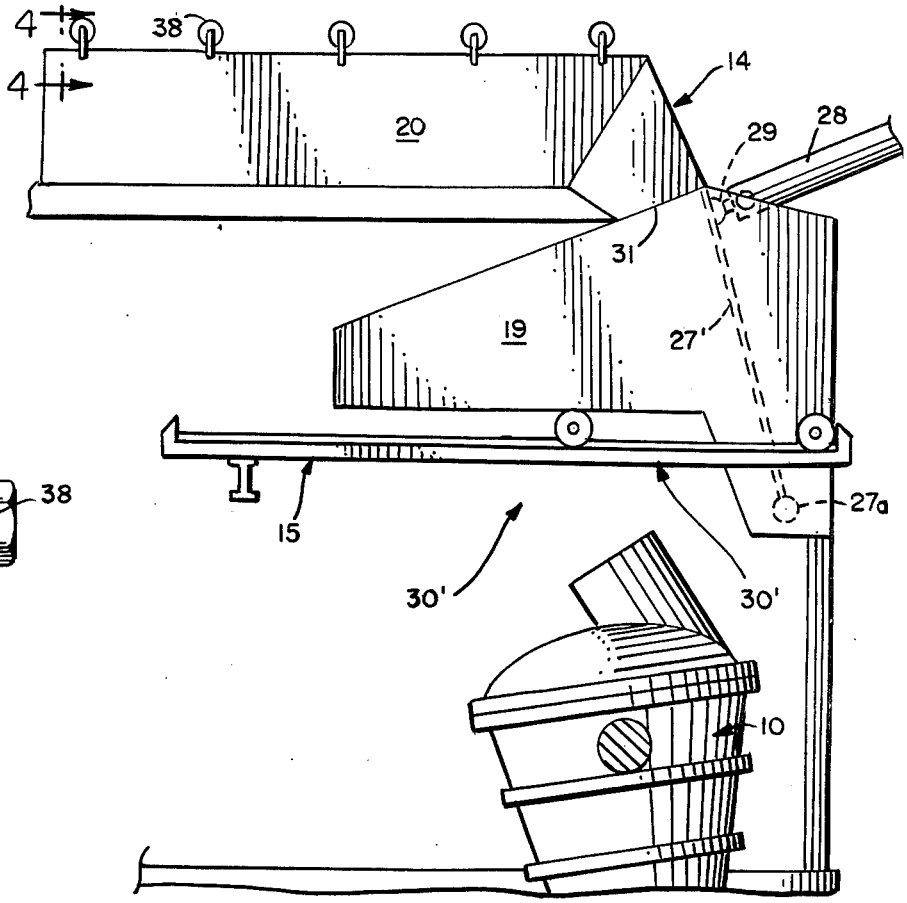
FIG. 4
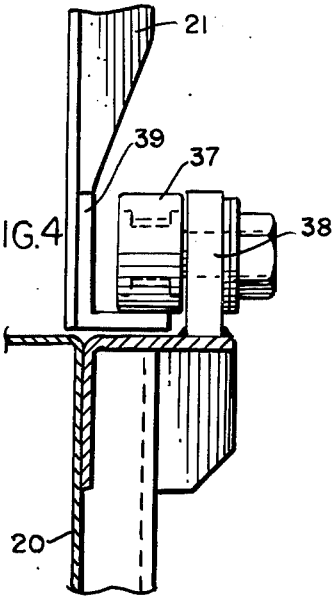
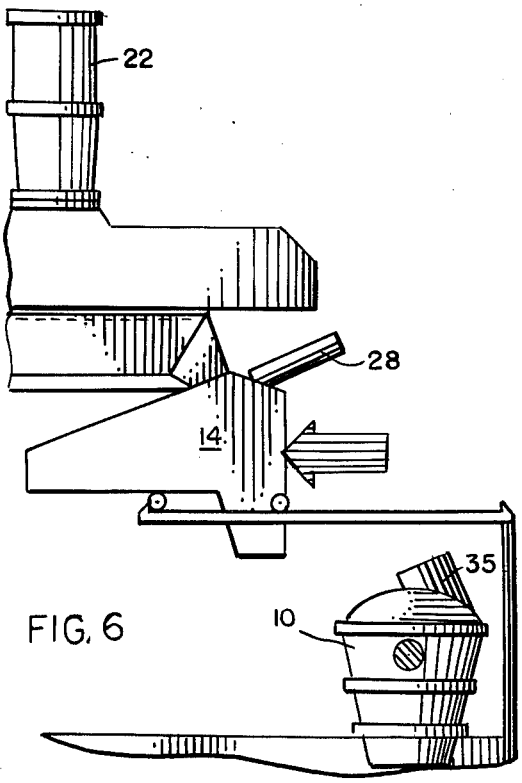
FIG. 6
FIG. 5
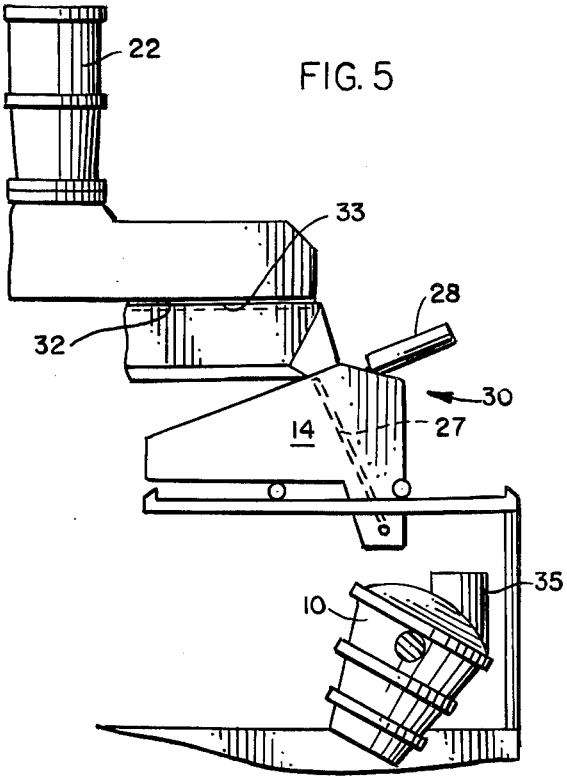

HOOD FOR STEEL PROCESSING VESSEL

BACKGROUND AND SUMMARY OF INVENTION

This invention relates to a hood suitable for a steel processing vessel and, more particularly, to a vessel utilizing argon-oxygen decarburization.

The first commercial heat utilizing argon-oxygen decarburization was produced in 1967. However, by the end of 1977, just ten years later, approximately 75–80% of the United States stainless steel production was made using this process. The process essentially is the decarburization of metal through the use of oxygen with argon or some other inert gas. The refining process is carried out in vessels similar to converters by blowing the oxygen-inert gas mixture into the molten bath through submerged tuyeres located in the lower sides of the vessel. The process is based upon thermodynamic equation for the oxidation of carbon in the presence of chromium:

$$Cr_3O_4 + 4C + 3Cr + 4\,CO(g)$$

This formula shows that for any given temperature, the partial pressure of CO must be reduced in order to maximize the Cr to C ratio. Lowering the partial pressure of CO can be done by mixing a gas that is preferable inert with the CO.

However, in addition to the carbon monoxide which is given off in the AOD process, substantial quantities of oxides such as those of iron, chromium and nickle evolve from the decarburization vessel. These metallic fumes are dense and therefore potentially injurious. Therefore it is imperative that some means such as a hood be provided to collect the fumes.

However, the problem was not solved simply by providing an enclosure with an exhaust fan because the argon-oxygen refining vessel had to be replaced from time-to-time because of the degeneration of the refractory lining and the vessel also adapted a number of different attitudes depending on the character of the operation, viz., blowing, charging, sampling, tapping, etc.

I have discovered that a two-part hood, one part being fixed while the other is movable and with the movable part being equipped with a draft damper in one face, has solved the problem of providing a means for maximum control of the metallurgical fumes while utilizing minimum quantities of air that have to be moved.

Further details and advantages of the invention may be seen in the ensuing specification.

DETAILED DESCRIPTION

The invention is described in conjunction with an illustrative embodiment in the accompanying drawing, in which FIG. 1 is a fragmentary side elevational view of an AOD installation featuring the inventive hood;

FIG. 3 is a view similar to FIG. 1 but featuring the decarburization vessel in the "refining" attitude;

FIG. 4 is an enlarged sectional view taken along the line 4—4 of FIG. 3;

FIG. 5 is a view similar to FIGS. 1 and 3 but featuring the decarburization vessel in the "charging" attitude; and FIG. 6 is a view similar to FIGS. 1, 3 and 4 and showing the hood in the position for replacing the decarburization vessel.

Figure 1:
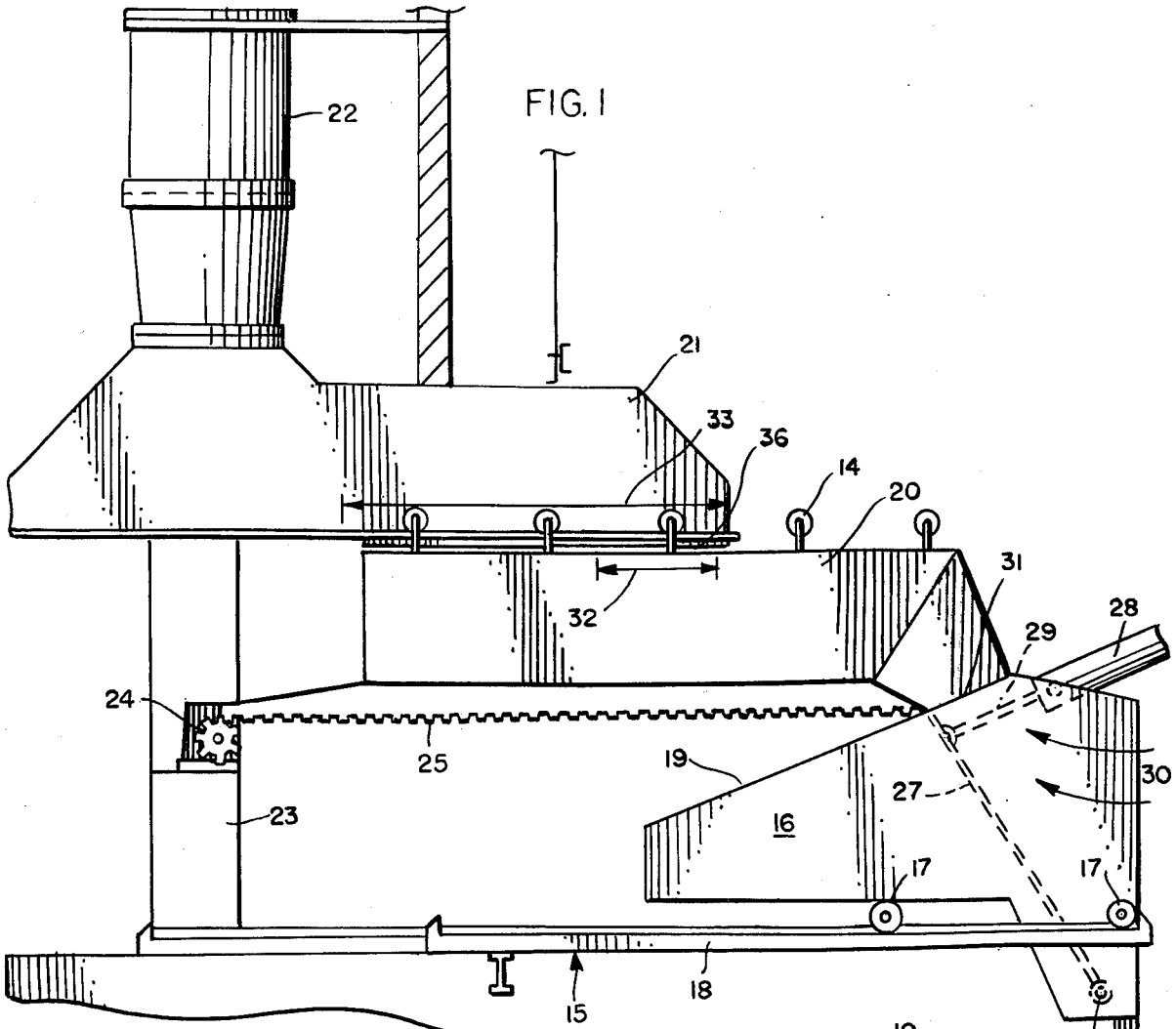
Figure 2:
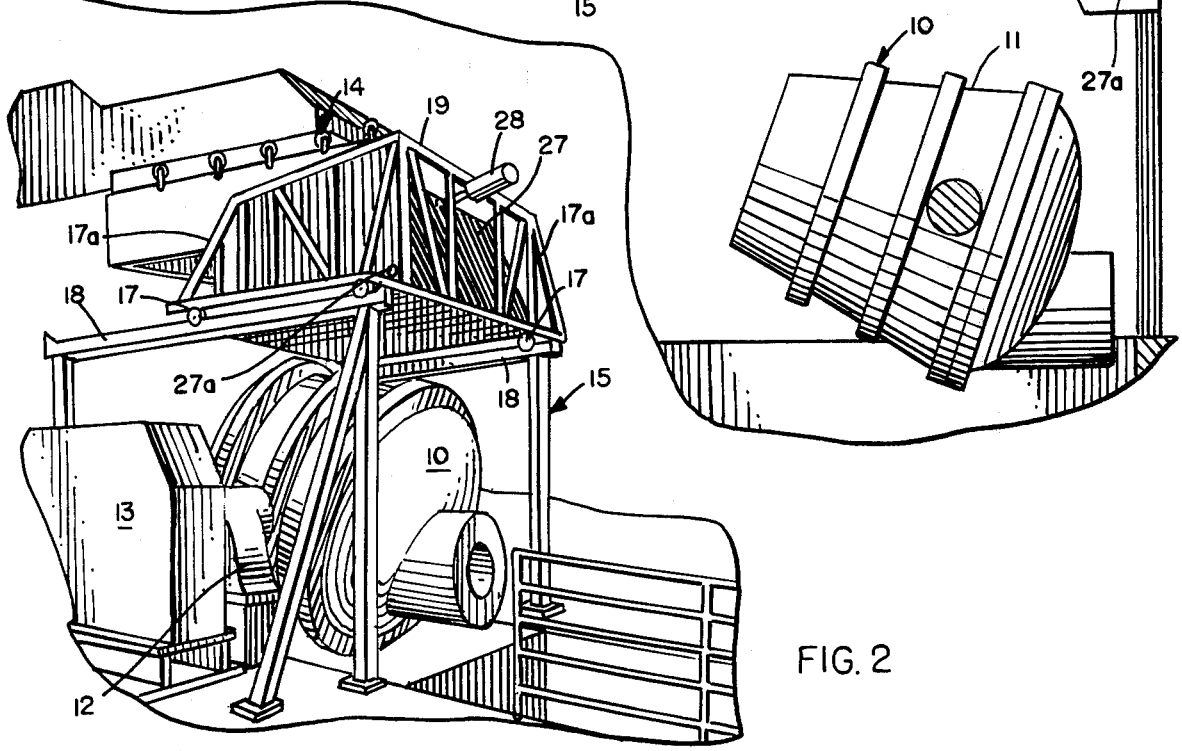
FIG. 2 is a perspective view (also fragmentary) of the apparatus of FIG. 1 and featuring the decrburization vessel in approximately the same "tapping" attitude.

In the illustration given and with reference first to FIG. 1, the numeral 10 designates generally a decarburization vessel which is seen in its attitude for being tapped, i.e., pouring the treated steel. The vessel is seen to be pivotally mounted as at 11 which may take the form of a trunnion pedestal 12 as seen in FIG. 2. The trunnion mounting makes possible the tipping of the vessel 10 by means of a suitable prime mover such as a motor and drive provided within the housing 13 (see the lower left hand portion of FIG. 2). Still referring to FIG. 2, the numeral 14 at the upper portion thereof designates generally the inventive hood which can be seen in greater detail in FIG. 1.

Referring now to FIG. 1, the numeral 15 designates generally a frame which (by comparing FIG. 1 with FIG. 2) is seen to flank and span the vessel 10. The hood 14 includes a movable part 16 which is slidably mounted on the frame 15, more particularly, the movable part 16 is equipped with two pairs of wheels as at 17 which roll in tracks on the upper beam members 18 of the frame 15. The movable hood part 16, in addition to including the generally trapezoidal part 19 also includes a movable duct 20 which is rigidly connected to the trapezoidal part 19 and moves with it for disposing the hood in different positions.

The hood 14 additionally includes a fixed part 21 which consists essentially of a collecting duct leading to a vertical duct 22. The stationary portion 21 of the hood 14 as well as the vertical duct 22 are suitably supported from the building as well as by the support 23 (see FIG. 1). The support 23 also carries a drive motor for a pinion 24 which, in combination with the rack 25 on the duct 20, moves the hood part 16 along the frame 15.

The trapezoidal portion 19 of the hood is constructed of framing members suitably interconnected as can be appreciated from a consideration of FIG. 2 and which are employed to support plates of stainless steel such as Type 321. This material of construction is especially advantageous in resisting corrosion which otherwise might occur from the hot fumes. More particularly, stainless steel plates are fastened to the hood frame with angle clips to facilitate changing warped or oxidized plates.

The front or forwardly facing surface of the trapezoidal portion 19 of the movable part 16 of the hood 14 is open and is selectively closed by a damper 27 which is seen in dotted line in FIG. 1. Also mounted on the trapezoidal portion 19 is an air cylinder 28 equipped with a piston rod 29 (see FIG. 1) which is connected to the damper to pivot the same around pivot shaft points *27a*.

As can be appreciated from a consideration of FIG. 1, air flow is indicated by means of arrows 30. The flow is essentially horizontal so that the hood 14 is serving as a side draft hood. This develops a substantial flow of air above the metal being poured from the vessel 10. The movable duct 20 is constructed so that it provides a plenum open only in a restricted portion as at 31 in its bottom wall.

Referring now to FIG. 3, the arrangement of parts of the AOD system is depicted as they are arranged during refining or "blowing", i.e., treating the charged metal with argon and oxygen. In this mode, the hood 14 is serving as a bottom draft close canopy hood, as can be appreciated from the position of the arrows 30'. In this case, the front or draft damper is designated by the numeral 27' and is seen to be pivoted somewhat clockwise from the showing in FIG. 1 — this due to the retraction of the piston rod 29 of the cylinder 28. In the illustration given, the movement of the damper 27 from one position to the other is through an arc of about 15°.

The position of the hood 14 relative to the framing 15 is the same in FIGS. 1 and 3, i.e., it is as far forward or in overlapping position relative to the vessel 10 as possible. The exhaust from the movable duct 20, in such an instance, passes through the opening 32 which is aligned with the forward portion of the opening 33 in the stationary part 21 of the hood.

Reference is now made to FIG. 5 where it is seen that the movable portions 16 and 20 of the hood 14 have been moved rearwardly relative to the frame 15 and the stationary part 21 of the hood. Now the upper opening 32 of the duct 20 is aligned with the rear portion of the bottom opening 33 of the stationary part 21. In the specific illustration given, the movable part of the hood 14 has been moved rearwardly approximately 5 to 5½ feet so that the front part of the hood 14 is approximately over the center line of the trunnion 11. Further, the damper 27 is positioned in its rearward orientation (the same as in FIG. 1) so that the hood is again serving as a side draft hood as indicated by the air flow arrows 30. In this mode, the vessel 10 can be charged from the ladle of chute member (not shown), the material entering the vessel through the pouring spout 35.

In FIG. 6, the hood 14 has been moved substantially rearwardly so that its front most part is essentially clear of the vessel 10 permitting a crane to remove the vessel 10 for replacement. In view of the tremendous wear and tear on the refractory lining of the vessel 10, it is normally necessary to replace the lining after every 50–60 heats. To operate most efficiently, this is done by removing the vessel 10 entirely from its trunnion mounting and utilizing a substitute vessel while the "spent" vessel is being relined. Thus, it is necessary every week or two to remove the decarburization vessel from its mounting.

As one specific example of the invention, the vessel 10 has a 20 ton capacity. For this the dust collector fan and duct work are all sized to handle 65,000 CFM of air for fume collection, at about 275° F. When the AOD vessel 10 is in the upright or refining position, the hood is moved considerably forward and the damper adjusted to draw the air from below the hood. In this mode, the hood is collecting the fume from the vessel at about 3,000° F. and is also drawing enough ambient air to mix with and cool this fume to about 275° F. for which the dust collector bags are normally rated.

The hood mounting on the four outrigger wheels 17 (see FIG. 2) permits the seiection of different positions over the vessel. More particularly, the frame of the trapezoidal portion 19 has outrigger frame portions 17*a* on both sides (see FIG. 2) Advantageously, the hood is driven back and forth by an electrical motor through a rack and pinion drive 24–25 with electrical controls for the positions of the hood and the damper located on a pedestal along with other vessel controls. A slip joint 36 (see FIG. 1) is provided between the ducts 20 and 21. This is achieved through the use of wheels 37 (see FIG. 4) which are mounted on pedestals 38 in turn being carried by the movable duct 20. The wheels 27 ride on angle flanges 39 provided on the fixed duct 21.

Through the hood arrangement, the large air volumes characteristic of prior high canopy hoods are avoided. Investigation of hoods for other AOD installations indicate large air volumes in the order of 500,000 to 1,000,000 CFM were required for ventilation. Further, with the compact arrangement of the trapezoidal portion 19, maintenance requirements are reduced.

I claim:

1. A hood suitable for a steel processing vessel comprising:

a frame flanking and spanning said vessel, a first hood portion movable horizontally on said frame from a first position overlying said vessel to a second position spaced rearwardly of the vessel for vessel removal, a second hood portion fixed relative to said frame and coupled to exhaust fan means, slip joint coupling said first and second hood portions together, a draft damper in the front of said first hood portion movable from a first position for developing generally vertical air flow to a second position or developing generally horizontal air flow, and means on said first hood portion for moving said draft damper.

2. The structure of claim 1 in which said first hood portion includes two parts, one of said parts being a generally trapezoidal hood equipped with wheels rollable on said frame and the other of said parts including an elongated duct having a forward lower opening coupled to said trapezoidal hood part, the upper portion of said duct being coupled through said slip joint to said second hood portion.

3. The structure of claim 2 in which said second hood portion has a relatively elongated, horizontally extending bottom opening, said elongated duct having an upper opening relatively foreshortened in comparison to the opening in said second hood portion.

* * * * *